United States Patent [19]

Swinney

[11] Patent Number: 4,769,517

[45] Date of Patent: Sep. 6, 1988

[54] JOYSTICK SWITCH ASSEMBLY

[76] Inventor: Carl M. Swinney, 13551 Ankerton St., Whittier, Calif. 90601

[21] Appl. No.: 37,595

[22] Filed: Apr. 13, 1987

[51] Int. Cl.[4] ..... H01H 25/00; G09F 9/30

[52] U.S. Cl. ..... 200/6 A; 340/709

[58] Field of Search ..... 200/5 R, 6 A, 17 R, 200/18, 153 K; 340/706, 709; 273/856, 148 B, DIG. 028

[56] References Cited

U.S. PATENT DOCUMENTS

| | | | |
|---|---|---|---|
| 4,027,119 | 5/1977 | Tezuka | 200/6 A |
| 4,297,542 | 10/1981 | Shumway | 200/6 A |
| 4,349,708 | 9/1982 | Asher | 200/6 A |
| 4,414,438 | 11/1983 | Maier et al. | 340/709 |
| 4,459,440 | 7/1984 | Wiczer | 200/6 A |
| 4,509,383 | 4/1985 | Yeh | 200/6 A X |
| 4,614,847 | 9/1986 | Sasao | 200/6 A |

*Primary Examiner*—J. R. Scott

*Attorney, Agent, or Firm*—Edgar W. Averill, Jr.

[57] ABSTRACT

An improved joystick switch assembly of the type which provides selectable on/off switches to a computer depending upon the position of the joystick. The switch assembly has a generally hemispherical base. When the joystick is tilted in the direction of one of the switches, such switch is closed by contact with the table or other support surface upon which the assembly rests.

12 Claims, 1 Drawing Sheet

JOYSTICK SWITCH ASSEMBLY

BACKGROUND OF THE INVENTION

The field of the invention is electrical switches and the invention relates more particularly to switches of the type referred to as joysticks which are commonly used in conjunction with computer programs and games.

A joystick switch typically gets a relatively rigorous use when used with a computer game. The typical joystick provides for switches in four directions such as north, south, east and west. Also, the joystick typically has a firing switch which is often positioned at the top or the front of the joystick and which is operated by the user's thumb or finger. Thus, typically, the switch has four individual direction switches of which, typically, only one switch is closed at any one time, plus a firing switch which may be closed at any time in addition to any of the other four switches. For some games, more than four switches may be used.

Joystick switches are shown in U.S. Pat. Nos. 4,439,649 and 4,382,166. Such switches typically are held in a housing and the firing button may either be in the housing or, preferably, in the joystick handle itself. Such switches have a relatively large number of parts and have limited life because of the wear provided in manipulation of the switch. Another joystick switch construction is shown in U.S. Pat. No. 4,394,548 which has a centrally located firing pin and a plurality of contact switches manipulated by the direction of movement of the joystick handle. A hand controller having a plurality of switches mounted on a curved surface is shown in U.S. Pat. No. 4,465,908. The switch requires the continued resilience of a flat spring plate and has a relatively large number of parts and is, thus, relatively expensive. A plurality of switches is shown in the device of U.S. Pat. No. 3,965,315 which utilizes a pair of blocks with a plurality of indentations which contain the switch buttons. Once again, a large number of parts results in a switch of limited life and relatively high cost.

SUMMARY OF THE INVENTION

It is an object of the present invention to provide a particularly simple to make, low cost and durable joystick switch assembly.

The present invention is for an improved joystick switch assembly of the type used to provide a plurality of selectable on/off switches to a computer. Such switches typically have a tiltable joystick handle, movable in a plurality of directions from the vertical wherein the movement in a first direction closes a first switch as long as the handle is held in said first direction and movement in another direction similarly closes another corresponding switch as long as the handle is held in said other direction. Movement in an intermediate direction can close two adjacent switches. The joystick handle includes a firing button at the top and/or front thereof for opening and closing a firing switch. The improvement comprises a joystick handle supporting carriage having a generally hemispherical bottom supported on a support surface. The center of the imaginary sphere of which the hemispherical bottom forms a part lies about on the longitudinal axis of the joystick handle. The joystick handle is held at its base by the joystick handle supporting carriage. A plurality of pressure sensitive switches are located between the support surface and the hemispherical bottom so that when the carriage is rocked toward one of the switches, the switch becomes positioned between the support surface and the hemispherical bottom and pressure is thus exerted thereon closing the switch. The hemispherical bottom may have a small flat area at the center to indicate the upright or neutral position of the joystick. The joystick handle supporting carriage may be held in a base member having a generally hemispherical bottom with a slightly greater radius than the radius of the hemispherical bottom and one or more springs may be positioned between the top of the base member and the top of the supporting carriage.

DESCRIPTION OF THE PREFERRED EMBODIMENTS

Figure 1:
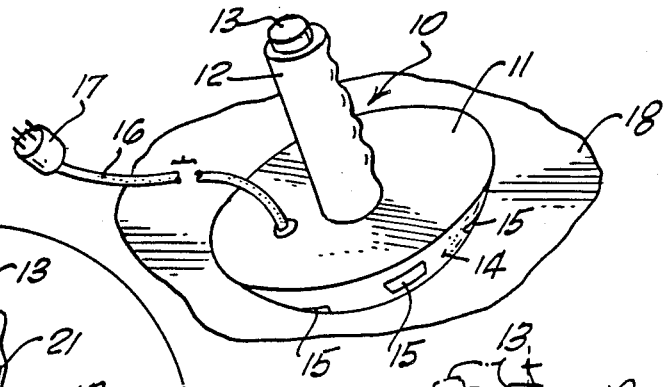
FIG. 1 is a perspective view of the improved joystick switch assembly of the present invention on a support surface.

The improved joystick switch assembly of the present invention is shown in FIG. 1 and indicated generally by reference character 10. Switch assembly 10 has a joystick handle supporting carriage 11 which holds a tiltable joystick handle 12 at its center. Handle 12 has a firing button 13 which is typically operated by the user's thumb as the user's hand is grasped around joystick handle 12. Supporting carriage 11 has a generally hemispherical bottom 14 upon which four pressure sensitive switches 15 are affixed. Switches 15 may be held in depressions molded in the surface of the generally hemispherical bottom 14 and the wires from the switches may be guided to a multi-conductor cable 16 having a plug 17 which may be inserted into a computer or other controlled device. The generally hemispherical bottom 14 rests on a support surface 18 which may simply be a table top provided by the user. Thus, in its simplest form, the switch assembly has a minimum of moving parts and simply has four or more switches located on its bottom surface and, optionally, a firing button switch located in the handle, which switches are wired into a cable which is plugged into the computer. Thus, a very simply injection molded part could be provided into which the switches are inserted to provide an exceptionally durable and inexpensive joystick.

Figure 2:
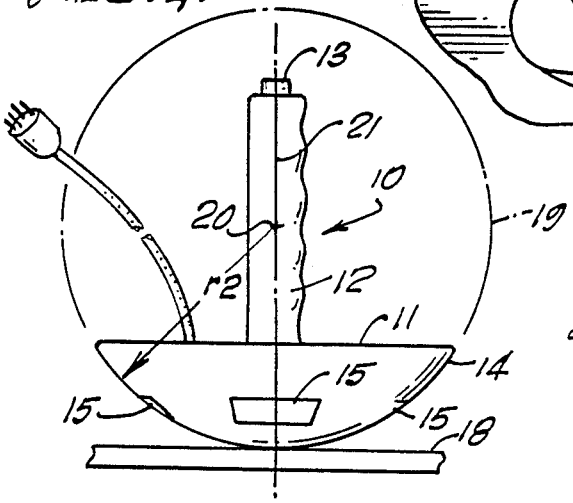
FIG. 2 is a side view thereof.

The switch assembly of FIG. 1 is shown in side view in FIG. 2 where the radius r1 of the imaginary sphere 19 (of which the generally hemispherical bottom 14 forms a part) is shown. It can be seen that the center 20 of imaginary sphere 19 lies along the longitudinal axis 21 of the tiltable joystick handle 12. By providing a hollow handle 12 and a solid carriage 11, the switch assembly will tend to sit in an upright position as shown in FIG. 2.

Figure 4:
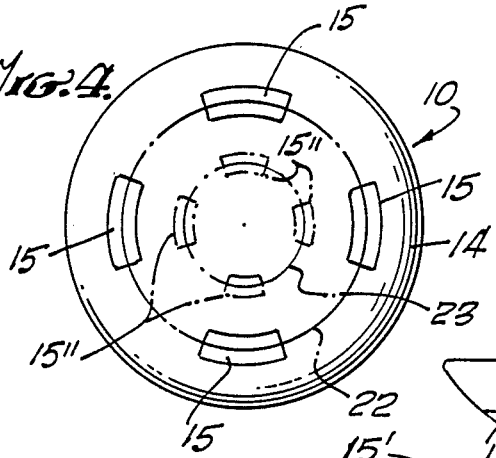
FIG. 4 is a bottom view of the joystick handle supporting carriage of FIG. 1.
Figure 6:
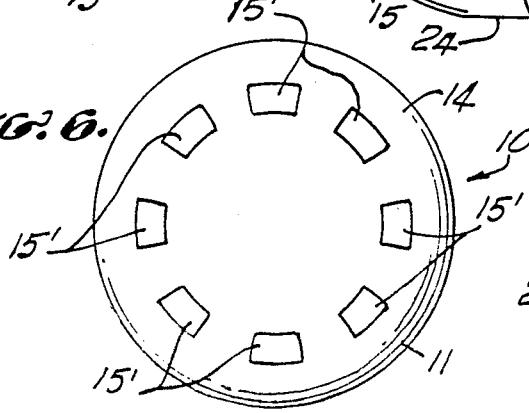
FIG. 6 is a bottom view of an alternate embodiment of the joystick handle supporting carriage of FIG. 1.

Pressure sensitive switches 15 may be of the type commonly used in pressure sensitive keypads wherein pressure exerted anywhere on the surface of the switch will cause the switch to close. The location of the switches on the surface of the generally hemispherical bottom 14 will determine the amount of movement necessary to operate the switch. Thus, as shown in FIG. 4, the switches 15 may lie along an imaginary circle 22 or the switches 15'' may lie along a smaller circle such as circle 23. As shown in FIG. 6, the number of switches 15' is not limited to four but may be 8, 12 or practically any number. Furthermore, it would be possible to place switches on more than one circle to create a different action depending upon the degree of rocking of the tiltable joystick handle 12. Still further, an intermediate tilting of the joystick can cause two adjacent switches to close, thus indicating tilting in a "northwest" direction when both the "north" and "west" switches are closed.

Figure 5:
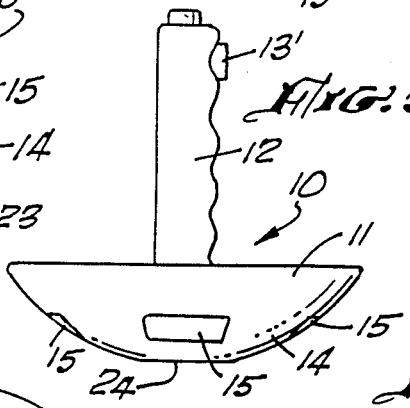
FIG. 5 is a side view of an alternate embodiment of the joystick handle supporting carriage of the joystick switch assembly of FIG. 1.

Another method of further emphasizing the vertical position of the joystick handle 12 is shown in FIG. 5 where a flat area 24 is located at the base of the generally hemispherical bottom 14. Also, the firing switch 13' is located on the side of handle 12 and is operable by the user's finger. The joystick of the present invention may also include both a top-mounted firing button, such as firing button 13 and a side-mounted button such as switch 13'.

Figure 3:
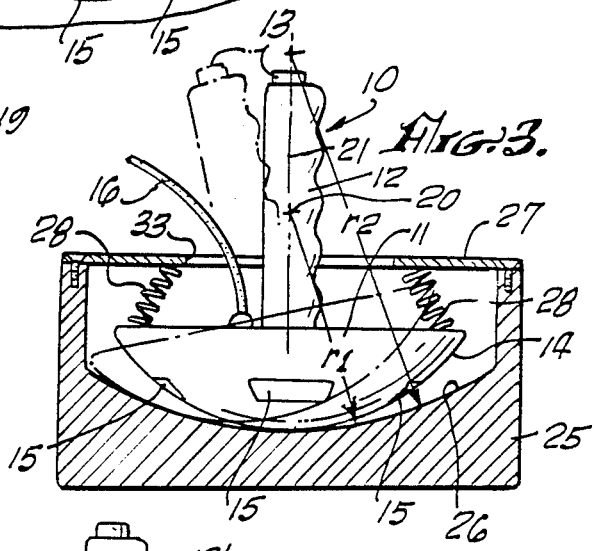
FIG. 3 is a side view partly in cross-section of the joystick handle supporting carriage of FIG. 1 held in a base member having a generally hemispherical bottom.

It is also possible that the joystick handle and support carriage 11 be mounted in a base member such as base member 25 shown in FIG. 3. Base member 25 has a generally hemispherical bottom 26 which has a radius r2 which is greater than the radius r1. In this way, a relatively small movement of tiltable joystick handle 12 causes a relatively large movement of the contact point between bottom 14 of carriage 11 and generally hemispherical bottom 26 of base member 25. It should be pointed out when the term "generally hemispherical" is used that this is intended to include elliptical, parabolic and other rounded shapes. Thus when the term "radius" is used, this may be an approximate value if the bottom shape is not exactly hemispherical.

Base member 25 has a removable top member 27 which holds a plurality of springs 28 between the top surface 29 of the joystick handle supporting carriage 11, which springs further urge the joystick handle to its vertical or neutral position. Top member 27 has a central opening 33 through which handle 12 protrudes.

Figure 7:
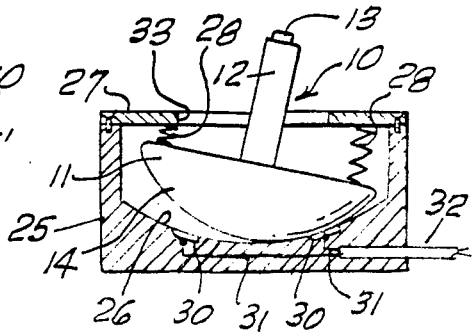
FIG. 7 is a side view partly in cross-section of an alternate embodiment of the joystick switch assembly of FIG. 3.

Although it is generally easiest to provide the switches and wiring within the joystick handle supporting carriage 11, it is also possible that the switches be located in the base member 25, as shown in FIG. 7, with the exception of the firing button switch is preferably located in handle 12. Thus, switches 30 are held in the generally hemispherical bottom 26 and a plurality of conductors 31 are fed into a multi-conductor cable 32 having a plug, not shown, which is plugged into the computer or other controlled device.

The joystick handle and supporting carriage may be simply injection molded from an impact-resistant polymer to provide an exceptionally low cost assembly. Although low in cost, the assembly would also have excellent life since the only moving parts in the basic unit, such as that shown in FIG. 1, are the switches which, of course, are an essential part of any joystick construction. Thus, the joystick assembly is reduced to an absolute minimum of moving parts.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. An improved joystick switch assembly of the type used to provide a plurality of selectable on/off switches to a computer, said switch being of the type having a tiltable joystick handle movable in a plurality of directions from the vertical and wherein the movement in a first direction closes a first switch as long as the handle is held in said first direction, and movement in another direction similarly closes another corresponding switch as long as the handle is held in said other direction, wherein the improvement comprises:

a joystick handle supporting carriage having a generally hemispherical bottom comprising a first contact surface, said carriage being supported on a support member having an upper support surface comprising a second contact surface, the center of the imaginary sphere of which the hemispherical bottom forms a part lying about on the longitudinal axis of said joystick handle and said joystick handle being held at its base by said joystick handle supporting carriage; and a plurality of pressure sensitive switches mounted on said first contact surface or said second contact surface, said plurality of pressure sensitive switches including said first switch and said another corresponding switch, one of said switches selectively being turned from an off position to an on position by contact between the first contact surface and the second contact surface at a point of contact when said joystick supporting carriage is rocked so that one of said pressure sensitive switches is located at the point of contact between said first and second contact surfaces

2. The improved joystick switch assembly of claim 1 wherein said plurality of pressure sensitive switches is mounted on said first contact surface.

3. The improved joystick switch assembly of claim 1 wherein said plurality of pressure sensitive switches is mounted on said second contact surface.

4. The improved joystick switch assembly of claim 1 wherein there are four of said pressure sensitive switches.

5. The improved joystick switch assembly of claim 1 wherein there are eight of said pressure sensitive switches.

6. The improved joystick switch assembly of claim 1 wherein said generally hemispherical bottom has a flat area at the center of the bottom thereof to provide a stable upright position of the joystick.

7. The improved joystick switch assembly of claim 1 wherein said joystick handle supporting carriage is held in a base member which has an upwardly directed generally hemispherical concave bottom comprising said second contact surface having a radius slightly greater than the radius of said first contact surface.

8. The improved joystick switch assembly of claim 7 further including a top member affixed to said base member which extends over the top of said joystick handle supporting carriage, said top member having a central opening through which said joystick handle extends.

9. The improved joystick switch assembly of claim 8 further including a plurality of biasing means located between the underside of said top member and the top of said joystick handle supporting carriage.

10. The improved joystick switch assembly of claim 1 wherein said joystick handle is hollow and said joystick handle supporting carriage is solid whereby said switch assembly will tend to sit in an upright position.

11. An improved joystick switch assembly of the type used to provide a plurality of selectable on/off switches to a computer, said switch being of the type having a tiltable joystick handle movable in a plurality of directions from the vertical and wherein the movement in a first direction closes a first switch as long as the handle is held in said first direction, and movment in another direction similarly closes another corresponding switch as long as the handle is held in said other direction, wherein the improvement comprises:

a joystick handle supporting carriage having a generally hemispherical bottom comprising a first contact surface, said carriage being supported on a support member being an upper support surface comprising a second contact surface, the center of the imaginary sphere of which the hemispherical bottom forms a part lying about on the longitudinal axis of said joystick handle and said joystick handle being held at its base by said joystick handle supporting carriage; and a plurality of pressure sensitive switches mounted on the supporting carriage on said second contact surface including said first switch and said another corresponding switch and positioned on a circle about the longitudinal axis of said joystick, one of said pressure sensitive switches selectively being turned from an off position to an on position by contact between the second contact surface and the first contact surface at a point of contact when said joystick supporting carriage is rocked so that one of said pressure sensitive switches is located at the point of contact between said first and second contact surfaces.

12. The improved joystick switch assembly of claim 11 wherein there are four pressure sensitive switches.

* * * * *